US006329114B1

(12) United States Patent
Watanabe et al.

(10) Patent No.: US 6,329,114 B1
(45) **Date of Patent: *Dec. 11, 2001**

(54) ELECTROSTATIC IMAGE DEVELOPING TONER, PRODUCTION METHOD THEREOF, ELECTROSTATIC IMAGE DEVELOPER AND IMAGE-FORMING PROCESS

(75) Inventors: Yukiko Watanabe; Takao Ishiyama; Manabu Serizawa; Takeshi Shoji; Yasuo Matsumura, all of Minamiashigara (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 10 days.

(21) Appl. No.: 09/453,822

(22) Filed: Dec. 3, 1999

(30) Foreign Application Priority Data

Feb. 17, 1999 (JP) ..... 11-038805

(51) Int. Cl.[7] ..... G03G 9/087; G03G 9/097; G03G 13/22

(52) U.S. Cl. ..... 430/110.4; 430/111.4; 430/124; 430/137

(58) Field of Search ..... 430/110, 111, 430/124, 137, 110.4, 111.4

(56) References Cited

U.S. PATENT DOCUMENTS

| | | | | |
|---|---|---|---|---|
| 5,362,593 | * | 11/1994 | Inoue et al. | 430/111 |
| 5,578,408 | * | 11/1996 | Kohtaki et al. | 430/111 |
| 5,637,433 | * | 6/1997 | Uchida et al. | 430/110 |
| 5,851,714 | * | 12/1998 | Taya et al. | 430/111 |
| 5,955,234 | * | 9/1999 | Matsunaga et al. | 430/110 |
| 5,968,701 | * | 10/1999 | Onuma et al. | 430/110 |
| 6,040,104 | * | 3/2000 | Nakamura et al. | 430/110 |

FOREIGN PATENT DOCUMENTS

| | | |
|---|---|---|
| A-59-218459 | 12/1984 | (JP) . |
| A-59-218460 | 12/1984 | (JP) . |
| A-63-282752 | 11/1988 | (JP) . |
| A-1-225967 | 9/1989 | (JP) . |
| A-2-101477 | 4/1990 | (JP) . |
| B2-2-37586 | 8/1990 | (JP) . |
| A-2-235069 | 9/1990 | (JP) . |
| A-4-69666 | 3/1992 | (JP) . |
| A-4-186368 | 7/1992 | (JP) . |
| A-5-61239 | 3/1993 | (JP) . |
| A-6-250439 | 9/1994 | (JP) . |
| A-9-120175 | 5/1997 | (JP) . |
| A-9-258481 | 10/1997 | (JP) . |
| A-10-26842 | 1/1998 | (JP) . |
| A-10-171156 | 6/1998 | (JP) . |
| A-10-198070 | 7/1998 | (JP) . |
| A-10-301332 | 11/1998 | (JP) . |
| A-11-2922 | 1/1999 | (JP) . |

* cited by examiner

*Primary Examiner*—Mark Chapman
(74) *Attorney, Agent, or Firm*—Oliff & Berridge, PLC

(57) ABSTRACT

An electrostatic image developing toner wherein in the dynamic viscoelasticity of the toner, the lowest temperature at which the value of the storage elastic modulus (G') of the toner coincides with the value of the loss elastic modulus (G") of the toner obtained under a frequency of 6.28 rad/second in a temperature dispersion measurement at a temperature of at least 0° C. is in the range of from 60 to 75° C., or the weight average molecular weight of the toner obtained by a GPC measurement is in the range of from 20,000 to 65,000 and the peak area that the molecular weight of the toner obtained by the GPC measurement is not larger than 1,000 is 3.0% or lower.

The toner is excellent in the document offset property, the bending resistance of the fixed image, the releasing property of the fixing sheet, and transparency of as optically projected image, has charging uniformity and a high stability, gives no fog and toner scattering, and can form images of excellent quality.

18 Claims, No Drawings

ELECTROSTATIC IMAGE DEVELOPING TONER, PRODUCTION METHOD THEREOF, ELECTROSTATIC IMAGE DEVELOPER AND IMAGE-FORMING PROCESS

FIELD OF THE INVENTION

The present invention relates to an electrostatic image developing toner used in the case of developing electrostatic images formed by an electrophotographic process, an electrostatic recording process, etc., and the production method thereof, an electrostatic developer, and an image-forming process.

BACKGROUND OF THE INVENTION

A process of visualizing an image information through electrostatic images, such as an electrophotographic process, etc., has been utilized in various fields at present. In an electrophotographic process, an electrostatic image is formed on a photoreceptor by electrostatic charging and light-exposure step, and the electrostatic latent image is developed by a developer containing a toner and visualized through a transferring step and a fixing step.

As the developer used in the process, a two-component developer composed of a toner and a carrier and a one-component developer using a magnetic toner or a non-magnetic toner singly are known. For producing a toner, a knead-grinding method of melt-kneading a thermoplastic resin together with a pigment, a charge-controlling agent, and a releasing agent such as a wax, and after cooling, finely grinding and classifying the kneaded mixture to obtain a toner is usually used. In the toner, if necessary, inorganic or organic fine particles are added to the surfaces of the toner particles for the purpose of improving the fluidity and the cleaning property thereof. By these methods, a considerably excellent toner can be produced but they have following various problems.

That is, in an ordinary knead-grinding method, the form and the surface structure of the toner produced are a random-form and because the form thereof is delicately changed according to the grinding property and the condition of the grinding step, it is difficult to control the form and the surface structure of the toner. Also, in the knead-grinding method, there is a restriction on the range of selecting the material. Practically, it is preferred that a resin coloring agent dispersion is sufficiently brittle and can be finely ground by an ordinary grinder but when a resin coloring agent dispersion is brittle, it sometimes happens that a fine powder is generated from the toner by receiving a mechanical shearing force in a developing apparatus and the form of the toner is changed. In a two-component developer, the fine power generated is fixed to the surfaces of carriers to accelerate the deterioration of the developer and in a one-component developer, scattering of the toner occur by enlarging the particle size distribution, the developing property is lowered by the change of the toner form, and the image quality becomes liable to be deteriorated.

Also, in the toner containing therein a large amount of a releasing agent such as a wax, etc., by the combination with a thermoplastic resin, the resin frequently gives an influence on the exposure of the releasing agent on the surface of the toner. Particularly, in the combination of the resin which has an increased elasticity by high-molecular weight components and is hard to be ground to some extent and a wax, which is brittle, such as polyethylene, polyethylene is frequently exposed on the surface of the toner. The toner is advantageous for the releasing property at fixing and cleaning of the untransferred toner from a photoreceptor but the polyethylene on the surface layer of the toner is easily transferred onto a developing roll, a photoreceptor, a carrier, etc., to stain them and to lower the reliability.

Furthermore, when the form of a toner becomes a random form, even by adding a fluidity assistant, the fluidity of the toner cannot sufficiently ensured, a fine powder transfers to the concaved portions of the toner by receiving the mechanical shearing force during use to lower the fluidity of the toner with the passage of time, and also the fluidity assistant is embedded in the inside of the toner to deteriorate the developing property, the transferring property and the cleaning property. Also, when the toner recovered by cleaning is returned to the developing apparatus and used again, the image quality is liable to be lowered. For preventing the occurrences of these troubles, the amount of the fluidity assistant is increased, black sports are formed on the photoreceptor and also scattering of the assistant particles occurs.

As described above, in an electrophotographic process, for stably keeping the performance of a toner under various mechanical stresses, it is important that the exposure of a releasing agent onto the surface of the toner, the surface hardness of the toner is increased without reducing the fixing property of the toner, the both the mechanical strength of the toner and the sufficient charging property and fixing property of the toner are improved.

Furthermore, recently, the requirement for increasing the image quality has been increased and particularly, in the formation of color images, for realizing the images of a high brilliance, the tendency of small-sizing of toner is remarkable. However, when a toner is simply small-sized in a conventional particle size distribution of the toner, by the existence of the toner of the fine particle size, staining of a carrier and a photoreceptor and scattering to the toner become severe, and thus it is difficult to simultaneously realize the high image quality and the high reliability. For solving the problem, it becomes important that the particle distribution of the toner is sharpened and small-sizing of the toner is made possible.

Recently, in a digital full-color copying machine and printer, after color-separating a color image original by each of the filers of B (blue), R (red), and G (green), electrostatic images each composed of dots of the diameters in the range of from 20 to 70 $\mu$m corresponding to the original are developed using each of the developers of Y (yellow), M (magenta), C (cyan), and Bk (black) by utilizing a subtractive mixing action. However, because in the digital full-color copying machine, etc., it is necessary to transfer large amounts of the developers as compared with a black and white copying machine, etc., of prior art and it is necessary to correspond to dots of smaller particle sizes, the uniform charging property, the durability, the toner strength, and the sharpness of the particle size distribution of the toner become more and more important. Also, considering the increase of the speed and the energy saving property of these copying machines, the low-temperature fixing property of the toner becomes more important. From these points, an aggregation unification method suitable for the production having a sharp particle size distribution and small particle sizes is excellent.

For the toner used for a full-color copying machine, etc., it is important that large amounts of the toners surely make color mixing and in this case, the improvement of the color reproducibility and the transparency of the OHP image become inevitable.

Also, as a means of controlling the form and the surface structure of a toner, a method of producing a toner by an emulsion polymerization aggregation method is proposed (Japanese Patent-Laid Open Nos. S63-282752 and H6-250439). According to the method, a resin fine particles dispersion is generally prepared, on the other hand, a coloring agent dispersion of a coloring agent dispersed in a solvent is formed, these dispersions are mixed to form aggregated particles having particle sizes corresponding to toner particle sizes, and the particles are formed into a coalescece by heating to product a toner. In the method, the form of the toner can be controlled to some extent and the charging property and the durability of the toner can be improved but it is difficult to control the dispersed state of the releasing agent and the coloring agent in the inside of the toner and in oil-less fixing, it is difficult to balance the releasing property of a sheet to be fixed and the transparency of the case of forming an OHP image.

In general, for the electrophotographic toner, a thermoplastic resin is used and to realize both low-energy fixing and a powder blocking property, it is proposed to optimum-control the rheology of the binder resin used for the toner and the glass transition point (Tg) of the binder resin (Japanese Patent Publication No. H2-37586, Japanese Patent Laid-Open Nos. H1-225967 and H2-235069).

Particularly, in a recent electrophotographic process, by the requirement of the progresses of the digital system and the high-speed system as described above, to cope with the far increase of the fixing speed, a binder resin having a lower glass transition temperature has been used.

However, when in the toner image containing the binder resin of this kind, heat of the temperature of the glass transition temperature of higher is applied to the image, there occurs a problem that the resin component of the image portion is melted and attaches to the back surface of the print or other prints to cause the defect of images, that is the problem of a document offset. Also, recently, double face printing has been increased but in this case because in the double face outputs, the images portions are inevitably in a contact state with each other, the occurrence of the image defects are more liable to occur than the case of one face output.

For improvement of the problem of the occurrence of the offset of these fixed output images, that is, the occurrence of the document offset, it is proposed that the both the offset resistance at fixing and the low-temperature fixing property and the transparency of the OHP image are realized, and also by curing the surface of the toner with a polyurethane resin and containing a adhesion resin together with a binder resin in the inside of the toner, both the offset resistance and the low-temperature fixing property are realized (Japanese Patent Laid-Open Nos. H4-186368, H2-101477, etc.).

However, these methods are effective for improving the document offset property, but because there is a tendency of stiffening the fixed images, when the fixed image is bent, an image defect becomes liable to occur. Also, because the melt viscosity of the toner is increased, the smoothness of the surface of the fixed image is liable to be reluctant to obtain and it sometimes happens that the surface gloss and the transparency of the OHP image are reduced.

Also, in general, for the purpose of preventing the occurrence of a low-temperature offset at fixing, a polyolefin-base wax is internally added to the toner as a releasing component and at the same time, a slight amount of a silicone oil is uniformly coated on the fixing roll to improve the high-temperature offset property. However, this method is undesirable because the silicone oil attaches to the output transfer material to cause an unpleasant sticky feeling occurs.

Thus, in Japanese Patent Laid-Open No. H5-61239, a toner for oil-less fixing containing a large amount of a releasing agent component in the toner is proposed. However, the addition of a large amount of a releasing agent can improve the releasing property but in this case a binder resin component is compatible with the releasing agent, oozing of the releasing agent becomes ununiform and the releasing property becomes unstable. Also, it sometimes happens that a free component of the releasing agent causes the hindrance of charging. Furthermore, in regard to the dispersibility of a pigment in the inside of the toner, by the interaction with the releasing agent, aggregates of the pigment are formed, which cause the problems of the hindrance of the transparency of the OHP image, the hindrance of coloring, etc.

On the other hand, for the purpose of improving the releasing property of a sheet to be fixed thereon, it has been proposed to add a crosslinking agent to the binder resin to improve the cohesive force of the binder resin is proposed (Japanese Patent Laid-Open Nos. S59-218459 and S59-218460). However, the method of simply adding a crosslinking agent to a binder resin increases the cohesive force of the binder resin itself, improves the releasing property of the toner, and makes it difficult to cause image defects (document offset) in the case of contacting imaged portions each other, but because the stiffness of the binder resin itself is increased, the bending resistance of the fixed image is lowered. Also, because the melt viscosity of the binder resin is increased, the smoothness of the surface of the fixed image is reduced, the gloss of the fixed image and the transparency of the OHP image are lowered, and the color mixing property in a full-color image is reduced.

Also, in Japanese Patent Laid-Open Nos. H4-69666 and H9-258481, a method of improving the apparent cohesive force of a binder resin by property adding thereto a high molecular amount component is proposed. In these methods, the cohesive force can be controlled to some extent by controlling the molecular weight and the glass transition temperature of the main binder resin component, but it is difficult to realize both the resistance to document offset (image defect) in the case of contacting imaged portions each other and the bending resistance.

SUMMARY OF THE INVENTION

Thus, the present invention solve the above-described problems and provide an electrostatic image developing toner excellent in the document offset resistance, the bending resistance of the fixed image, the releasing property of the sheet to be fixed, the transparency of an OHP image, etc.; having high charging uniformly and stability; giving no fog and scattering; and capable of forming excellent image quality. This invention also provide the preparing method of the electrostatic image developing toner, a developer for developing electrostatic images using the toner, and an image-forming method using the developer.

That is, as the result of various investigations for solving the above-described problems, the present inventions have found that those advantages can be attained by employing the following constitutions described below and have accomplished the present invention.

The present invention also provide an electrostatic image developing toner wherein the lowest temperature of the dynamic viscoelasticity of the toner, at which the value of the storage elastic modulus (G') of the toner coincides with the value of the loss elastic modulus (G") of the toner obtained under a frequency of 6.28 rad/second in a temperature dispersion measurement at a temperature of at least 0° C., is in the range of from 60 to 75° C.

The preferable weight average molecular weight of the toner obtained by the measurement of a gel permeation chromatography (GPC) is in the range of from 20,000 to 65,000 and the peak area of the molecular weight obtained by the GPC measurement, having not larger than 1,000 of the molecular weight is 3.0% of lower of the whole.

The glass transition temperature (Tg) of the toner may be in the range of from 50 to 65° C.

The volume mean particle size distribution index GSDv of the toner may not be more than 1.30 and the ratio of said GSDv to the number mean particle size distribution index GSDP of the toner is at least 0.95.

The content of a releasing agent may be in the range of from 5 to 25% by weight converted as solid components.

The median diameter (center diameter) of the releasing agent particles dispersed in the toner may be in the range of from 150 to 1500 nm measured by the transmission type electron microscope (TEM).

The content of a colorant may be in the range of from 4 to 15% by weight converted as solid components.

The median diameter (center diameter) of the colorant particles dispersed in the toner may be in the range of from 100 to 330 nm measured by the transmission type electron microscope (TEM).

The shape factor SF1 of the toner may be in the range of from 110 to 145.

The cumulative volume mean particle size $D_{50}$ may be in the range of from 3 to 9 $\mu$m.

The charged amount of the toner may be in the range of from 20 to 40 $\mu$C/g in the absolute value.

As a method for preparing the above toner, the following method will be provided: The method having a step of preparing a dispersion of aggregated particles containing resin fine particles, a coloring agent, and a releasing agent by mixing a resin fine particle dispersion having dispersed therein the resin fine particles having particle sizes of not larger than 1 $\mu$m, a coloring agent dispersion, and a releasing agent dispersion and a step of heating the aggregated particles to a temperature of at least a glass transition point of the above-described resin fine particles to coalesce the above-described aggregated particles, wherein in the preparation step of the aggregated particle dispersion, at least one kind of a polymer of a metal salt is used.

In this method, the following steps may also be introduced: In succession the above-described preparation step of the aggregated particle dispersion, an attaching step of forming attached particles by mixing the above-described aggregated particle dispersion and the resin fine particle dispersion to attach the resin fine particles to the surfaces of the aggregated particles is formed and then a step of coalescing step of the attached particles is formed.

In this method, the mean particle size of the above-described resin fine particles attaching to the aggregated particles may not be larger than 1 $\mu$m.

In this method, as the above-described polymer of a metal salt, a polymer of the inorganic metal salt of tetravalent aluminum may be used.

In this method, the above-described toner is the electrostatic image developing toner.

In this method, the above-described carrier has a resin coating layer.

An image-forming method is also provided having a step of forming an electrostatic latent image on an electrostatic image-carrier, a step of forming a toner image by developing the electrostatic latent image with a developer on a developer-carrier, a step of transferring the toner image onto a transfer material, a step of transferring the toner image on the transfer material onto fixing sheet, and a step of heat-fixing the transferred toner image, wherein as the developer, the electrostatic image developer described in above-described is used.

The image forming method may further including, a step of recovering the remaining toner on the electrostatic image-carrier after transferring and a step of recycling said toner onto the developer-carrier.

DETAILED DESCRIPTION OF THE INVENTION

Then, the electrostatic image developing toner of this invention and the production method there are described in detail.

The toner of this invention may be produced by a kneading and grinding method, a polymerization method, a hetero-aggregation method, etc., but by a method of using a dispersion by an ionic surface active agent of resin fine particles generally produced by an emulsion polymerization, etc., forming a hetero-aggregate by mixing the dispersion with a coloring agent dispersion dispersed in an ionic surface agent of the opposite polarity to form aggregated particles corresponding to the toner, thereafter, heating the aggregated particles to a temperature of at least the glass transition temperature of the resin to coalesce the aggregated particles, and washing and drying to obtain the toner, the toner having a form of from a random-form to a sphere form can be properly produced.

Also, the above-described method is a method of mixing all the raw material dispersions and aggregating the mixture, but the following method may be employed. That is, the balance of the amounts of the polar ionic dispersions is previously shifted in the initial state of the aggregation step, the dispersions are ionic-neutralized using, for example, an inorganic metal salt such as calcium nitrate, etc., or a polymer of an inorganic metal salt, such as poly aluminum chloride, etc., 1st stage parent material aggregated particles are formed at a temperature of lower than the glass transition point of the resin, after stabilizing, particle dispersion of the polarity and the amount of compensating the above-described shift of the balance are added thereto as a 2nd stage, after, if necessary, further stabilizing the mixture by heating a temperature of slightly higher than the glass transition temperature of the resin contained in the parent material aggregated particles or the added particles, the mixture is heated to a temperature of higher than the glass transition temperature to coalesce the particles while the particles added in the 2nd state are attached to the surfaces of the parent material aggregated particles. Furthermore, the stepwise operation of the aggregation may be repeated plural times.

Also, the resin particles may contain a releasing agent in an amount of from 5 to 25% by weight converted as solid component per weight of the toner. It is preferred to add the releasing agent before attaching the addition particles from the points of the charging property and the durability.

It is appropriate that the volume mean particle size $D_{50}$ of the toner of this invention is in the range of from 3 to 9 $\mu$m, and preferably from 3 to 8 $\mu$m. If $D_{50}$ is less than 3 $\mu$m, it sometimes happens that the charging property becomes insufficient and the developing property is lowered, and if $D_{50}$ exceeds 9 $\mu$m, the resolving property of the image formed is lowered.

Also, it is preferred that the volume mean particle size distribution index GSDv of the toner of this invention is 1.30 or lower and the ratio of the volume mean particle size distribution index GSDv to the number mean particle size distribution index GSDp is 0.95 or higher.

If the volume mean particle size distribution index GSDv exceeds 1.30, the resolving property is lowered and the ratio of the volume mean particle size distribution index GSDv to the number mean particle size distribution index GSDp is lower than 0.95, the charging property is lowered and scattering of the toner occurs to cause the image defects such as fog, etc.

The particle sizes and the particle size distribution index of the toner of this invention are obtained as follows. That is, based on the particle size distribution measured using a measurement apparatus such as, for example, Coulter Counter TA 11 (manufactured by Nikkaki K.K.), Multisizer II (manufactured by Nikkaki K.K.), each cumulative distribution described from the small particle side about the volume and the number for the divided particle size ranges (channels), the particle sizes becoming the cumulation of 16% are defined to be volume $D_{16v}$, and number $D_{16P}$, and the particle sizes becoming the cumulation of 50% are defined to be $D_{50v}$, and $D_{50P}$ respectively. Furthermore, the particle sizes becoming the cumulation of 84% are defined to be $D_{84v}$ and number $D_{84P}$ respectively. Using these values, the volume mean particle size distribution index (GSDv) is obtained from $D_{84v}/D_{16v}$ and the number mean particle size distribution (GSDP) is obtained from $D_{84P}/D_{16p}$.

It is proper that the charged amount of the electrostatic image developing toner of this invention is in the range of 20 to 40 $\mu$C/g, and preferably from 15 to 35 $\mu$C/g as the absolute value. If the charged about is lower than 20 $\mu$C/g as the absolute value, a background strain (fog) becomes liable to form, while if the charged amount exceeds 40 $\mu$C/g, the image density becomes liable to be lowered. Also, it is proper that the ratio of the electrostatic image developing toner in summer (high temperature, high humidity: 28° C., 85% RH) to the charged amount thereof in winter (low temperature, low humidity: 10° C., 30% RH) is in the range of from 0.5 to 1.5, and preferably from 0.7 to 1.3. When the ratio of the volume mean particle size distribution index GSDv to the number mean particle size distribution index GSDp is lower than 0.95, the environmental reliance of the charging property becomes strong and the toner is lacking in the stability of charging, which is undesirable for practical use.

There is no particular restriction on the polymer used for the resin fine particles in this invention but examples of the polymer include the polymers of monomers, for example, styrenes such as styrene, para-chlorostyrene, α methylstyrene, etc.; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.; vinylnitriles such as acrylonitrile, methacrylonitrile, etc.; vinyl ethers such as vinyl methyl ether, vinyl isobutyl ether, etc.; vinyl ketones such as vinyl methyl ketone, vinyl ethyl ketone, vinyl isopropenyl ketone, etc.; and olefins such as ethylene, propylene, butadiene, etc.; or the copolymers obtained by combining 2 or more kinds of these monomers, mixtures of the polymers and copolymers; non-vinylic condensation type resins such as an epoxy resin, a polyester resin, a polyurethane resin, a polyamide resin, a cellulose resin, a polyether resin, etc., and mixtures of these resins and the above-described vinylic polymers; and a graft polymer obtained by polymerizing the vinylic monomer in the co-existence of them.

About the above-described vinylic monomers, resin fine particle dispersion can be formed by emulsion polymerizing the vinylic monomer using an ionic surface active agent. About other resins, a resin fine particle dispersion can be formed by using a resin which is dissolved in an oily solvent having a relatively low solubility in water, dissolving the resin in the solvent, dispersing the resin in water as the fine particles thereof together with an ionic surface active agent and a high molecular electrolyte by a dispersing apparatus such as a homogenizer, and then evaporating off the solvent by heating or evacuating.

In addition, the particle sizes of the resin fine particles of the resin fine particle dispersion obtained can be measured by, for example, a laser refraction type particle size distribution measurement apparatus (LA-700, manufactured by HORIBA, LTD.

It is proper that the center diameter of the resin fine particles used in this invention is 50 to 400 nm, and preferably from 70 to 350 nm. If the center diameter is less than 50 nm, the aggregation rate is liable to be lowered and lowering of the productivity and extending of the particle size distribution are liable to occur. Also, if the center diameter exceeds 400 nm, the aggregating property is good, but the aggregates become liable to contain voids, it becomes difficult to form spherical particles and also it becomes difficult to control the form of the particles.

In general, the molecular weight of the toner itself, the glass transition temperature of the toner, the presence or absence of a crosslinking structure, etc., appear in the changing behaviors of the storage elastic modulus and the loss elastic modulus of the dynamic viscoelasticity of the binder resin. That is, when the weight average molecular weight Mw is large, Tg becomes high and when a crosslinking structure is formed, the stuffiness of the binder resin itself is increased and the governing property of the storage elastic modulus becomes large. On the contrary, when Mw is small and Tg is low, the revealing property of the storage elastic modulus becomes large. However, because the high molecular material used as the binder resin has both the above-described Mw and Tg, it is difficult to describe it by one factor.

Thus, the present inventors have found that the lowest temperature in the temperature region of 0° C. or higher at which the storage elastic modulus and the loss elastic modulus containing both the factors become equivalent, that is a crossover temperature is an important factor for the revealing properties of them, and have accomplished the present invention.

It is proper that the crossover temperature of the storage elastic modulus and the loss elastic modulus obtained by measuring the temperature dispersion of the dynamic viscoelasticity of the toner used in this invention is in the range of from 60 to 75° C., and preferably from 63 to 70° C.

If the crossover temperature is lower than 60° C., the cohesive power of the resin is lowered, whereby the revelation of the loss elastic modulus, which is the viscous property of the binder resin itself, becomes large. As the result thereof, the stiffness of the fixed image is lowered and the offset property at contacting the images each other, that is the document offset property is reduced. Also if the crossover temperature exceeds 75° C., because the contribution of the viscous property of the binder resin itself is greatly lowered to strongly reveal a brittle property, the durability (image-attaching property) at bending the fixed image, that is, the bending resistance of the fixed image is lowered. Furthermore, in the viscosity at melting the binder resin, because the elasticity largely reveals, which is accompanied by the phenomenon of a leveling property, and as the result thereof, the gloss of the fixed image is undesirably lowered.

For the measurement of the dynamic viscoelasticity in this invention, a temperature dispersion measurement by a sine wave oscillation method is preferably used and, for example, an ARES measurement apparatus manufactured by Rheometric Scientic Co., is used. In the case of measuring the dynamic viscoelasticity, after usually forming a toner into a tablet, the tablet is set to a parallel plate having a diameter of 8 mm, and after adjusting the normal force to 0, a sine wave oscillation of an oscillation frequency of 6.28 rad/second is applied. The measurement is continued to a temperature of from 30 to 200° C. The measurement interval is 10 second and the temperature raising speed is 3° C/minute as constant. Also, it is preferred that the temperature-controlling accuracy after initiating the measurement is ±1.0° C. or lower from the view point of the measurement accuracy. Also, during the measurement, the strain amount of properly kept at each measurement temperature and is properly controlled so that an appropriate measurement value is obtained. From the measurement results obtained in these measurement temperatures, the storage elastic modulus and the loss elastic modulus are calculated and from cross point thereof, the crossover temperature is obtained.

It is preferred that the weight average molecular weight Mw of the toner used in this invention is in the range of from 20,000 to 65,000 in the measurement by a gel permeation chromatography (GPC), and the peak area, that molecular weight of the toner obtained by the GPC measurement, having 1,000 or lower of the molecular weight is 3.0% or lower of the whole. When Mw is lower than 20,000, the resin in poor in the cohesive force and a hot offset occurs at fixing. Also, when Mw exceeds 65,000, the stiffness if the resin becomes large and the bending resistance of a fixing sheet at fixing is spoiled. Furthermore, when the peak area the molecular weight of the toner is 1,000 or less exceeds 3.0% of the whole, an offset occurs at fixing and an image defect occurs. Moreover, in the case of releasing documents, which were in contact with each other for a long time, from each other, an image defect is liable to occur and the document offset property is liable to be lowered.

The glass transition temperature (Tg) of the toner used in this invention is in the range of from 50 to 65° C., and preferably from 53 to 63° C. If Tg is lower than 50° C., the document offset property of the fixed images is lowered and if Tg exceeds 65° C., the bending resistance of the fixed image is reduced.

In addition, for the measurement of the molecular weight and the glass transition temperature (Tg) of the toner of this invention, DSC-7 (differential thermal analyzer) manufactured by The Perkin-Elmer Corporation., is used. For the temperature correction of the detecting portion of the apparatus, the melting points of indium and zinc are used and for the correction of the quantity of heat, the molten heat of indium is used. As the sample, an aluminum-made pan is used and by setting an empty pan is used for a contrast and the measurement is carried out at a temperature-raising speed of 10° C./minute. For the calculation of the peak area of the molecular weight, the peak area is sliced per retention time range and from the area ratio, the distribution ratio is obtained.

In this invention, the document offset property is evaluated as follows. A toner is uniformly attached onto a paper of a size of 40 mm×40 mm in an electrostatic field of 10 kV at a ratio of 5.0 g/m$^2$, the attached toner is fixed under the conditions of a process speed of 100 mm/second, a nip pressure of 2.5 kg/cm$^2$, and a temperature of 160° C. to provide a sample. Two such samples are prepared, the fixed toner images are contacted to each other, and they are allowed to stand or 7 days in an atmosphere of 60° C. under a load of 80 g/cm$^2$. Thereafter, They are released from each other and the presence or absence of a document offset is visually confirmed and evaluated.

The releasing agent used in this invention is preferably a substance wherein the main body maximum endothermic peak measured according to ASTM D3418-8 is in the range of from 50 to 140° C. is preferred. If the peak is lower than 50° C., an offset becomes liable to occur at fixing. Also, if the peak exceeds 140° C., the fixing temperature becomes high, the smoothness of the surface of the fixed image is not obtained, and the gloss of the fixed image is spoiled.

For the measurement of the main body maximum endothermic peak in this invention, DSC-7 (differential thermal analyzer) manufactured by Perkin-Elmer Co., is used. For the temperature correction of the detecting portion of the apparatus, the melting points of indium and zinc are used and for the correction of the quantity of heat, the molten heat of indium is used. As the sample, an aluminum-made pan is used and by setting an empty pan is used for a contrast and the measurement is carried out at a temperature-raising speed of 10° C./minute.

As the releasing agent used in this invention, for example, low molecular weight polyolefins such as polyethylene, polypropylene, polybutene, etc.; silicones having a softening point by heating; fatty acid amides such as oleic acid amide, erucic acid amide, ricinolic acid amide, stearic acid amide, etc.; vegetable waxes such as a carnauba wax, a rice wax, a candelilla wax, a Japan wax, a jojoba oil, etc.; animal waxes such as a beeswax, etc.; mineral and petroleum waxes such as a montan wax, ozokerite, ceresin, a paraffin wax, a microcrystalline wax, a Fisher-Tropsch wax, etc.; and the modified products of them can be used.

The wax is dispersed in water together with an ionic surface active agent and a high molecular electrolyte such as a high molecular acid, a high molecular base, etc., and fine particles are formed by heating to a temperature of higher than the melting point of the wax and also applying strong shearing by a homogenizer or a pressure-injection type dispersing apparatus to prepare a dispersion of the releasing agent particles having particle sizes of 1 $\mu$m or shorter.

In this invention, it is proper that the addition amount of the releasing agent dispersed in the toner is in the range of from 5 to 25% by weight to the weight part of the toner.

The center diameter of the releasing agent particles in the releasing agent dispersion obtained is measured by, for example, a laser diffraction type particle size distribution measurement apparatus (LA-700, manufactured by HORIBA, LTD.). It is proper that the center diameter of the releasing agent particles is in the range of from 50 to 400 nm, and preferably from 70 to 350 nm. If the center diameter is less than 50 nm, the necessary amount of the releasing agent at fixing becomes liable to be increased and if the center diameter exceeds 400 nm, the aggregation is sometimes liable to become unstable.

The colorant used in this invention is selected from the view points of the hue, the saturation, the lightness, the weather resistance, the transparency of the OHP image, and the dispersibility thereof in the toner.

Examples of the colorant include are black pigments such as carbon black, copper oxide, manganese dioxide, aniline black, active carbon, non-magnetic ferrite, magnetite, etc.;

yellow pigments such as chrome yellow, zinc yellow, yellow iron oxide, Cadmium Yellow, Chrome Yellow, Hansa Yellow, Hansa Yellow 10G, Benzidine Yellow G, Benzidine Yellow GR, Durene Yellow, Quinoline Yellow, Permanen t Yellow NCG, etc.;

orange pigments such as red chrome yellow, molybdenum orange, Permanent Orange GTR, Pyrazolone Orange, Vulcan Orange, Benzidine Orange G, Indanthrene Brilliant Orange RK, etc.;

red pigments such as iron oxide red, cadmium red, red lead, mercury sulfide, Watchung Red, Permanent Red 4R, Lithol Red, Brilliant Carmine 3B, Brilliant Carmine 6B, Du Pont Oil Red, Pyrazolone Red, Rhodamine BLake, Lake Red C, Rose Bengal, Eosine Red, Alizarine Lake, etc.;

blue pigments such as Prussian blue, Cobalt Blue, Alkali Blue Lake, Victoria Blue Lake, Fast Sky Blue, Indanthrene Blue BC, Aniline Blue, Ultramarine Blue, Chalcooil Blue, Methylene Blue Chloride, Phthalocyanine Blue, Phthalocyanine Green, Malachite Green Oxalate, etc.;

purple pigments such as manganese purple, Fast Violet B, Methyl Violet Lake, etc.;

green pigments such as chromium oxide, Chrome Green, Pigment Green, Malachite Green Lake, Final Yellow Green G, etc.;

white pigments such as zinc white, titanium oxide, Antimony White, zinc sulfide, etc.;

extender pigments such as a barite powder, barium carbonate, clay, silica, white carbon, talc, alumina white, etc.; and dyes such as various kinds of basic dyes, acidic dyes, dispersion dyes, direct dyes, etc., for example, Nigrosine, Methylene Blue, Rose Bengal, Quinoline Yellow, and Ultramarine Blue.

These pigments and dyes may be used singly, or as a mixture thereof, or further in the state of a solid solution.

The colorant can be dispersed in a dispersion by a known method and, for example, a media type dispersing machine such as a rotary shearing type homogenizer, a ball mill, a sand mill, an attriter, etc., a high-pressure counter impact type dispersing machine, etc., is preferably used.

In this invention, the addition amount of the colorant dispersed in the toner is suitable in the range of from 4 to 15% by weight. In addition, when a magnetic material is used as a black coloring agent, the addition amount thereof is different from the addition amounts other colorant and is properly in the range of 30 to 100% weight.

The center diameter of the colorant particles in the colorant dispersion obtained is measured by, for example, a laser diffraction type particle size distribution measurement apparatus (LA-700, manufactured by HORIBA, LTD.). The proper center diameter of the coloring agent particles is in the range of from 100 to 330 nm. If the center diameter is less than 100 nm, the viscosity of the dispersion is liable to increase and if the center diameter exceeds 330 nm, the light-transparency of an OHP image is liable to be lowered.

Also, when the toner is used as a magnetic toner, the toner may contain a magnetic powder. As the magnetic powder, a substance which is magnetized in a magnetic field is used, and a ferromagnetic powder such as iron, cobalt, nickel, etc., and a compound such as ferrite, magnetite, etc., are used.

In this invention, particularly, because the toner is produced in an aqueous phase, it is necessary to pay a care the migration property of a magnetic material into an aqueous phase. It is preferred to use the magnetic material by modifying the surface thereof, for example by applying a hydrophobic property-imparting treatment.

The shape factor SF1 of the toner of this invention is preferably in the range of from 110 to 145 from the point of the image-forming property. The shape factor SF1 is calculated, for example, by the following method as an average value of [(peripheral length)$^2$/projected area].

That is, the optical microscopic image of toner particles scattered on a slide glass is incorporated in a Luzex image analyzing apparatus through a video camera, the (peripheral length)$^2$/projected area ($ML^2/A$) of at least 50 toners is calculated and the average value of them is obtained.

For the toner of this invention, a charge-controlling agent can be used for improving and stabilizing the charging property of the toner. As the charge-controlling agent, various charge-controlling agents, which are usually used, such as quaternary ammonium salt compounds; Nigrosine-base compounds; dyes made of complexes of aluminum, iron, chromium, etc.; triphenylmethane-base pigments, etc., can be used but from the view points of controlling the ionic strength giving influences on the stability at the aggregation and the coalescence and the reduction of the occurrence of a waste water pollution, a material which is hard to dissolve in water is preferred.

To the toner of this invention can be added inorganic fine particles by a wet system for stabilizing the charging property. As the inorganic fine particles added, known materials which are usually used as an external additive to the surface of a toner, such as silica, alumina, titania, calcium carbonate, magnesium carbonate, tri-calcium phosphate, etc., can be used and in this case, it is preferred to use the inorganic fine particles as a dispersion thereof using an ionic surface active agent, a high molecular acid, or a high molecular base.

Also, in the toner of this invention, it is preferred that for the purposes of imparting a fluidity and improving the cleaning property, after drying the toner, inorganic fine particles of silica, alumina, titania, calcium carbonate, etc., or resin fine particles of a vinylic resin, polyester, silicone, etc., are added to the surface of the toner while applying shearing.

In the production method of the toner of this invention, as a surface active agent used for the emulsion polymerization, the dispersion of the resin fine particles, the dispersion of the colorant, the dispersion of the releasing agent, the aggregation of the particles, and/or the stabilization thereof, it is effective to use together, for example, an anionic surface active agent of, a sulfuric acid ester salt-base, a sulfonic acid salt-base, a phosphoric acid ester-base, a soap-base, etc.; a cationic surface active agent of an amine salt-type, a quaternary ammonium salt-type, etc.; and a nonionic surface active agent of a polyethylene glycol-base, an alkylphenol ethylene oxide addition product-base, a polyhydric alcohol-base, etc. As the dispersing means, a rotary shearing type homogenizer, a ball mill having a media, a sand mill, a dynomill, etc., can be used.

Also, in the case of using a complex made of the resin and the coloring agent, the complex can be prepared by a method of solving or dispersing the resin and the coloring agent in a solvent, dispersing the solution or the dispersion in water together with the above-described proper dispersing agent, and removing the solvent by heating or evacuation to provide the composite, a method applying a mechanical shearing force to the surfaces of resin fine particles prepared by an emulsion polymerization, or a method of electrically adsorbing and fixing can be used. These methods are effective for restraining the occurrence of the liberation of the coloring agent as addition particles and improving the colorant reliance of the charging property.

After finishing the polymerization, the desired toner is obtained through an optional washing step, a solid-liquid separation step, and drying step, and in the washing step, it is preferred to apply a sufficient displacement washing with ion-exchanged water from the point of the charging property. Also, there is no particular restriction on the solid-liquid separation step, but from the point of the productivity, a suction filtration, a press-filtration, etc., is preferred. There is also no restriction on the drying step, but from the point of productivity, freeze-drying, flash jet drying, fluid drying, vibration type fluid drying, etc., is preferably used.

In this invention, by employing the above-described constructions, excellent images in the fixing characteristics such as the document offset property, the bending resistance of the fixed image, the releasing property of the fixing sheet, the transparency of the OHP image, etc.; having high charging uniformity stability, and giving no fog and toner scattering can be provided.

Then, the present invention is explained practically by the following examples but the invention is not limited thereby.

The toner of this invention is obtained as follows. That is, each of the resin fine particle dispersion, the colorant dispersion, and the releasing agent dispersion described below is prepared, there are mixed with a desired ratio and while mixing the mixture, the polymer of an inorganic metal salt is added to the mixture followed by ionic-neutralizing to form aggregated particles. After adjusting the pH of the inside of the system with an inorganic hydroxide from a weak acidic property to neutral, the aggregated particles are heated to a temperature of at least the glass transition temperature of the above-described resin fine particles to coalesce the particles. Thereafter, through the steps of sufficient washing, the solid-liquid separation, and drying, a desired toner is obtained. Then, the preparation method of each dispersion is explained.

Preparation of resin fine particle dispersion 1:

| | |
|---|---|
| Styrene | 315 parts by weight |
| n-Butyl acrylate | 85 parts by weight |
| Acrylic acid | 6 parts by weight |
| Dodecane thiol | 6 parts by weight |
| Carbon tetrabromide | 4 parts by weight |

First, the above-described components (total 416 parts by weight) are mixed to prepare a solution. On the other hand, 6 parts by weight of a nonionic surface active agent (Nonipol 400, trade name, manufactured by Kao Corporation) and 10 parts by weight of an anionic surface active agent (Neogen SC, trade name, manufactured by DAI-ICHI KOGYO SEIYAKU CO., LTD.) are dissolved in 550 parts by weight of ion-exchanged water, the above-described solution is added to the solution and disperses and emulsifies therein in a flask and while stirring and mixing slowly for 10 minutes, 50 parts of ion-exchanged water having dissolved therein 4 parts by weight of ammonium persulfate is added to the emulsion. Then, after sufficiently replacing the inside atmosphere of the system with nitrogen, while stirring the mixture in the flask, the flask is heated to 70° C. by an oil bath and the emulsion polymerization is continued as it is for 5 hours to obtain an anionic resin fine particle dispersion 1 containing fine resin particles having a center diameter of 171 nm, a glass transition temperature of 54° C., and Mw of 34,300.

Preparation of resin fine particle dispersion 2:

| | |
|---|---|
| Styrene | 300 parts by weight |
| n-Butyl acrylate | 100 parts by weight |
| Acrylic acid | 3.25 parts by weight |
| Dodecane thiol | 4 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 2 containing resin fine particles having a center diameter of 178 nm, a glass transition temperature of 50.0° C., and Mw of 64,300.

Preparation of resin fine particle dispersion 3:

| | |
|---|---|
| Styrene | 340 parts by weight |
| n-Butyl acrylate | 60 parts by weight |
| Acrylic acid | 6 parts by weight |
| Dodecane thiol | 6 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 3 containing resin fine particles having a center diameter of 178 nm, a glass transition temperature of 64.8° C., and Mw of 49,000.

Preparation of resin fine particle dispersion 4:

| | |
|---|---|
| Styrene | 300 parts by weight |
| n-Butyl acrylate | 100 parts by weight |
| Acrylic acid | 6 parts by weight |
| Dodecane thiol | 2 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 4 containing resin fine particles having a center diameter of 169 nm, a glass transition temperature of 53.3° C., and Mw of 64,500.

Preparation of resin fine particle dispersion 5:

| | |
|---|---|
| Styrene | 330 parts by weight |
| n-Butyl acrylate | 70 parts by weight |
| Acrylic acid | 6 parts by weight |
| Dodecane thiol | 5 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 5 containing resin fine particles having a center diameter of 173 nm, a glass transition temperature of 62.3° C., and Mw of 47,200.

Preparation of resin fine particle dispersion 6:

| | |
|---|---|
| Styrene | 325 parts by weight |
| n-Butyl acrylate | 75 parts by weight |
| Acrylic acid | 6 parts by weight |
| Dodecane thiol | 8 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 6 containing resin fine particles having a center diameter of 168 nm, a glass transition temperature of 57.4° C., and Mw of 51,000.

Preparation of resin fine particle dispersion 7:

| | |
|---|---|
| Styrene | 310 parts by weight |
| n-Butyl acrylate | 90 parts by weight |
| Acrylic acid | 6 parts by weight |
| Dodecane thiol | 1.5 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 7 containing resin fine particles having a center diameter of 176 nm, a glass transition temperature of 53.7° C., and Mw of 44,500.

Preparation of resin fine particle dispersion 8:

| | |
|---|---|
| Styrene | 300 parts by weight |
| n-Butyl acrylate | 100 parts by weight |
| Acrylic acid | 6 parts by weight |
| Dodecane thiol | 8 parts by weight |
| Carbon tetrabromide | 5 parts by weight |

By following the same procedure as the preparation of the resin fine particle dispersion 1 using the above-described components, an emulsion polymerization is carried out to obtain an anionic resin fine particle dispersion 8 containing resin fine particles having a center diameter of 177 nm, a glass transition temperature of 50.6° C., and Mw of 22,100.

Preparation of resin fine particle dispersion 9:

| | |
|---|---|
| Styrene | 290 parts by weight |
| n-Butyl acrylate | 110 parts by weight |
| Acrylic acid | 6 parts by weight |
| Dodecane thiol | 6 parts by weight |
| Carbon tetrabromide | 4 parts by weight |

By following the same procedure as the preparation of the resin fine particle dispersion 1 using the above-described components, an emulsion polymerization is carried out to obtained an anionic resin fine particle dispersion 9 containing resin fine particles having a center diameter of 170 nm, a glass transition temperature of 48.1° C., and Mw of 32,500.

Preparation of resin fine particle dispersion 10:

| | |
|---|---|
| Styrene | 360 parts by weight |
| n-Butyl acrylate | 40 parts by weight |
| Acrylic acid | 6 parts by weight |
| Dodecane thiol | 8 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 10 containing resin fine particles having a center diameter of 166 nm, a glass transition temperature of 53.7° C., and Mw of 19,800.

Preparation of resin fine particle dispersion 11:

| | |
|---|---|
| Styrene | 310 parts by weight |
| n-Butyl acrylate | 90 parts by weight |
| Acrylic acid | 6 parts by weight |
| Dodecane thiol | 1.5 parts by weight |
| Carbon tetrabromide | 4 parts by weight |

By following the same procedure as the preparation of the resin fine particle dispersion 1 using the above-described components, an emulsion polymerization is carried out to obtain an anionic resin fine particle dispersion 11 containing resin fine particles having a center diameter of 173 nm, a glass transition temperature of 53.7° C., and Mw of 44,500.

Preparation of colorant dispersion 1:

| | |
|---|---|
| Cyan pigment (Copper Phthalocyanine B15:3, manufactured by DAINICHISEIKA COLOR & CHEMICALS MFG. CO., LTD.) | 50 parts by weight |
| Nonionic surface active agent (Nonipole 400, manufactured by Kao Corporation) | 5 parts by weight |
| Ion-exchanged water | 200 parts by weight |

The above-described components are mixed and dispersed by a homogenizer (Ultratalax, manufactured by IKA Co., for 10 minutes to obtain a colorant dispersion 1 containing the pigment particles having a center diameter of 168 nm.

Preparation of colorant dispersion 2:

By following the same procedure as the preparation of the colorant dispersion 1 except that a yellow pigment (PY180, manufactured by Clariant Japan Co.) is used as a colorant, a colorant dispersion 2 containing the pigment particles having a center diameter of 175 nm is obtained.

Preparation of colorant dispersion 3:

By following the same procedure as the preparation of the colorant dispersion 1 except that a magenta pigment (PR122, manufactured by DAINIPPON INK AND CHEMICALS, INC.) is used as a colorant, a colorant dispersion 3 containing the pigment particles having a center diameter of 186 nm is obtained.

Preparation of colorant dispersion 4:

By following the same procedure as the preparation of the colorant dispersion 1 except that a black pigment (carbon black, manufactured by Cabot Corporation) is used as a colorant, a colorant dispersion 4 containing the pigment particles having a center diameter of 159 nm is obtained.

Preparation of releasing agent dispersion 1:

| | |
|---|---|
| Paraffin wax (HN0190, melting point 85° C., manufactured by Nihon Seiro K. K.) | 50 parts by weight |
| Cationic surface active agent, Sanizole B50, manufactured by (Kao Corporation) | 5 parts by weight |
| Ion-exchanged water | 200 parts by weight |

After heating the above-described components to 95° C. and sufficiently dispersing using a homogenizer (Ultratalax, manufactured by IKA Co.), the dispersed mixture is subjected to a dispersion treatment by a press-injection type homogenizer to obtain a releasing agent 1 containing the releasing agent particles having a center diameter of 180 nm.

Preparation of toner 1:

| | |
|---|---|
| Resin fine particle dispersion 1 | 200 parts by weight |
| Colorant dispersion 1 (solid component conversion in the dispersion 19.6% by weight) | 40 parts by weight |
| Releasing agent dispersion 1 (solid component conversion in the dispersion 19.6% by weight) | 50 parts by weight |
| Poly aluminum chloride | 1.23 parts by weight |

After sufficiently mix.dispersing the above-described components by a homogenizer (Ultratalax T50, manufactured by IKE Co.) in a stainless-made flask, the dispersed mixture is heated to an aggregation temperature of 52° C. by a heating oil bath while stirring the mixture in the flask. Thereafter, after keeping the mixture at 52° C. for 60 minutes, 60 parts by weight of the resin fine particle dispersion 1 is further added thereto and the resultant mixture is moderately stirred.

Thereafter, after adjusting the pH in the system to 6.0 with an aqueous sodium hydroxide solution of 0.5 mol/liter, the stainless-made flask is closed, the mixture is heated to 97° C. while continuously stirring using a magnetic seal, thereafter, the pH in the system is adjusted to 4.0, and the system is kept for 6 hours. After the reaction is finished, the reaction mixture is cooled and filtrated, and after sufficiently washing with ion-exchanged water, a solid-liquid separation is applied by a Nutche-type suction filtration. Furthermore, the solid product is dispersed again in 3 liters of ion-exchanged water of 40° C., the dispersion is stirred at 300 rpm. for 15 minutes to wash the product.

After repeating the washing operation 5 times, a solid-liquid separation is carried out using a filter paper No. 5A by a Nutche-type suction filtration. Then, by continuing vacuum drying for 12 hours, a toner 1 is obtained.

Preparation of toner 2:

By following the same procedure as the production of the toner 1 except that the resin fine particle dispersion 2 is used in place of the resin fine particle dispersion 1, the solid components of the releasing agent particles are changed to 8.5% by weight to the solid components of the resin fine particles, similarly, the solid components of the colorant particles are changed to 9.6% by weight to the solid components of the resin fine particles, the aggregation temperature is changed to 45° C., and the pH in the system at reaching 97° C. is changed to 4.2, a toner 2 is obtained.

Preparation of toner 3:

By following the same procedure as the production of the toner 1 except that the resin fine particle dispersion 3 is used in place of the resin fine particle dispersion 1, the solid components of the releasing agent particles are changed to 24.8% by weight to the solid components of the resin fine particles, similarly, the solid components of the colorant particles are changed to 11.3% by weight to the solid components of the resin fine particles, the aggregation temperature is changed to 62° C., and the pH in the system at reaching 97° C. is changed to 4.1, a toner 3 is obtained.

Preparation of toner 4:

By following the same procedure as the production of the toner 1 except that the resin fine particle dispersion 4 is used in place of the resin fine particle dispersion 1, the solid components of the releasing agent particles are changed to 23.1% by weight to the solid components of the resin fine particles, similarly, the solid components of the colorant particles are changed to 5.0% by weight to the solid components of the resin fine particles, and the aggregation temperature is changed to 47° C., a toner 4 is obtained.

Preparation of toner 5:

By following the same procedure as the production of the toner 1 except that the resin fine particle dispersion 5 is used in place of the resin fine particle dispersion 1, the solid components of the releasing agent particles are changed to 8.3% by weight to the solid components of the resin fine particles, similarly, the solid components of the colorant particles are changed to 13.4% by weight to the solid components of the resin fine particles, the aggregation temperature is changed to 60° C., and the pH in the system at reaching 97° C. is changed to 5.5, a toner 5 is obtained.

Preparation of toner 6:

By following the same procedure as the production of the toner 1 except that the resin fine particle dispersion 6 is used in place of the resin fine particle dispersion 1, the solid components of the releasing agent particles are changed to 20.0% by weight to the solid components of the resin fine particles, similarly, the solid components of the colorant particles are changed to 6.2% by weight to the solid components of the resin fine particles, and the aggregation temperature is changed to 61° C and kept for 3 hours, a toner 6 is obtained.

Preparation of toner 7:

By following the same procedure as the production of the toner 1 except that the resin fine particle dispersion 7 is used in place of the resin fine particle dispersion 1, the solid components of the releasing agent particles are changed to 10.1% by weight to the solid components of the resin fine particles, similarly, the solid components of the colorant particles are changed to 6.1% by weight to the solid components of the resin fine particles, the aggregation temperature is changed to 43° C., and the pH in the system at reaching 97° C. is changed to 5.3, a toner 7 is obtained.

Preparation of toner 8:

By following the same procedure as the production of the toner 1 except that the resin fine particle dispersion 8 is used in place of the resin fine particle dispersion 1, the solid components of the releasing agent particles are changed to 8.3% by weight to the solid components of the resin fine particles, similarly, the solid components of the colorant particles are changed to 6.2% by weight to the solid components of the resin fine particles, and the aggregation temperature is changed to 51° C. and kept for 2 hours, a toner 8 is obtained.

Preparation of toner 9:

By following the same procedure as the production of the toner 1 except that the resin fine particle dispersion 9 is used in place of the resin fine particle dispersion 1, the solid components of the releasing agent particles are changed to 29.0% by weight to the solid components of the resin fine particles, similarly, the solid components of the colorant particles are changed to 3.5% by weight to the solid components of the resin fine particles, the aggregation temperature is changed to 50° C. and kept for 4 hours, and the pH in the system at reaching 97° C. is changed to 4.5 and kept for 10 hours, a toner 9 is obtained.

Preparation of toner 10:

By following the same procedure as the production of the toner 1 except that the resin fine particle dispersion 10 is used in place of the resin fine particle dispersion 1, the solid components of the releasing agent particles are changed to 4.3% by weight to the solid components of the resin fine particles, similarly, the solid components of the colorant particles are changed to 16.0% by weight to the solid components of the resin fine particles, the aggregation temperature is changed to 50° C. and kept for 4 hours, and the pH in the system at reaching 97° C. is changed to 5.6, a toner 10 is obtained.

Preparation of toner 11:

By following the same procedure as the production of the toner 1 except that the resin fine particle dispersion 11 is used in place of the resin fine particle dispersion 1, the solid components of the releasing agent particles are changed to 12.0% by weight to the solid components of the resin fine particles, similarly, the solid components of the colorant particles are changed to 9.7% by weight to the solid components of the resin fine particles, the aggregation temperature is changed to 66° C., and the pH in the system at reaching 97° C. is changed to 4.0, a toner 11 is obtained.

Preparation of toner 12:

By following the same procedure as the production of the toner 1 except that in the production of the toner 1, the aggregation time is changed to 90 minutes and the temperature after finishing the aggregation is changed to 85° C. and kept for 3 hours, a toner 12 is obtained.

Preparation of toner 13:

By following the same procedure as the production of the toner 2 except that in the production of the toner 2, the aggregation time is changed to 2 hours and the temperature after finishing the aggregation is changed to 85° C. and kept for 3 hours, a toner 13 is obtained.

Preparation of toner 14:

By following the same procedure as the production of the toner 3 except that in the production of the toner 3, the aggregation time is changed to 3 hours and the temperature after finishing the aggregation is changed to 97° C. and kept for 10 hours, a toner 14 is obtained.

Preparation of toner 15:

By following the same procedure as the production of the toner 5 except that in the production of the toner 5, the aggregation temperature is changed to 65° C. and kept for 90 minutes and the temperature after finishing the aggregation is changed to 85° C. and kept for 3 hours, a toner 15 is obtained.

Preparation of toner 16:

By following the same procedure as the production of the toner 8 except that in the production of the toner 8, the aggregation time is changed to 60 minutes and the temperature after finishing the aggregation is changed to 85° C. and kept for 3 hours, a toner 16 is obtained.

Preparation of toner 17:

By following the same procedure as the production of the toner 2 except that in the production of the toner 2, the aggregation time is changed to 3 hours, the temperature after finishing the aggregation is changed to 85° C., and the pH in the system is changed to 4.0 and kept for 10 hours, a toner 17 is obtained.

Preparation of toner 18:

By following the same procedure as the production of the toner 1 except that in the production of the toner 1, the coloranr dispersion 2 is used in place of the colorant dispersion 1, a toner 18 is obtained.

Preparation of toner 19:

By following the same procedure as the production of the toner 1 except that in the production of the toner 1, the coloranr dispersion 3 is used in place of the colorant dispersion 1, a toner 19 is obtained.

Preparation of toner 20:

By following the same procedure as the production of the toner 1 except that in the production of the toner 1, the colorant dispersion 4 is used in place of the colorant dispersion 1, a toner 20 is obtained.

Preparation of toner 21:

The resin fine particle dispersion 1 is subjected to a solid-liquid separation with a filter paper of No. 5A and the solid residue is vacuum-dried at 40° C. to obtain resin fine particles. To 1740 parts by weight of the resin fine particles is added 170 parts by weight of the cyan pigment (Copper Phthalocyanine B 15:3, manufactured by DAINICHISEIKA COLOR & CHEMICALS MFG. CO., LTD.) used for the colorant dispersion 1, after adding thereto 270 parts by weight of the paraffin wax (HNP 0190, manufactured by Nihon Seiro K.K.) used for the releasing agent dispersion 1, the mixture is kneaded by a roll mill, rolled by an extruder and air-cooled, then, ground by a hammer mill, and the ground product is classified by an inertia classifier to obtain a toner 21 having $D_{50}$ of 5.1 $\mu$m. The GSDv of the toner is 1.23 and GSDv/GSDp is 0.98.

Preparation of externally added toner:

To 50 g of each of the toner 1 to toner 21 described above is added 1.8 g of hydrophobic silica (TS720, made by Cabot Corporation) and the mixture is mixed by a sanpmill to obtain each externally added toner. The externally added toner is added to a ferrite carrier having a volume mean particle size $D_{50}$ of 50 $\mu$m coated with 1% by weight a methacrylate (manufactured by Sookenkagaku Sha K.K.) such that the toner concentration became 5% by weight and the mixture is mixed by stirring for 5 minutes in a ball mill to prepare each developer.

EXAMPLE 1

About the above-described toner 1, when the crossover temperature of the storage elastic modulus G' and the loss elastic modulus G" is obtained from the temperature dispersion measurement of the dynamic viscoelasticity measurement, it is 62.5° C. Also, the weight average molecular weight Mw of the toner obtained by the GPC measurement is 30,020 and the peak area that the molecular weight of the toner is 1,000 or lower obtained by a GPC peak slice method is 2.5% of the whole. Also, the glass transition temperature of the toner is 54° C. When the particle sizes of the toner are measured by a Coulter counter, the volume mean particle size $D_{50}$ is 5.43 $\mu$m, the volume mean particle size distribution index GSDv is 1.23, the ratio of the volume mean particle size distribution index GSDv to the number mean particle size distribution GSDp is 1.10. Furthermore, it is observed that the shape factor SF1 of the toner particles obtained by the form observation by Luzex is 117 and a sphere form. When the cross-sectional image of the toner is observed by transmission type electron microscope (TEM), the releasing agent is dispersed in the toner particles, the center diameter (median diameter) of the releasing agent is 837 nm, and the center diameter (median diameter) of the colorant is 168 nm.

When the charging property of the toner is measured, the toner shows a good charging property of −38.4 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 2

About the above-described toner 2, when the crossover temperature of the storage elastic modulus G' and the loss elastic modulus G" is obtained from the temperature dispersion measurement of the dynamic viscoelasticity measurement, it is 72° C. Also, the weight average molecular weight Mw of the toner obtained by the GPC measurement is 63,400 and the peak area that the molecular weight of the toner is 1,000 or lower obtained by a GPC peak slice method is 0.3% of the whole. Also, the glass transition temperature of the toner is 50.5° C. When the particle sizes of the toner are measured by a Coulter counter, the volume mean particle size $D_{50}$ is 3.14 $\mu$m, the volume mean particle size distribution index GSDv is 1.21, the ratio of the volume mean particle size distribution index GSDv to the number mean particle size distribution GSDp is 1.08. Furthermore, it is observed that the shape factor SF1 of the toner particles obtained by the form observation by Luzex is 123 and a sphere form. When the cross-sectional image of the toner is observed by transmission type electron microscope (TEM), the releasing agent is dispersed in the toner particles, the center diameter (median diameter) of the releasing agent is 512 nm, and the center diameter (median diameter) of the colorant is 316 nm.

When the charging property of the toner is measured, the toner shows a good charging property of −26.4 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 3

About the above-described toner 3, when the crossover temperature of the storage elastic modulus G' and the loss elastic modulus G" is obtained from the temperature dispersion measurement of the dynamic viscoelasticity measurement, it is 75° C. Also, the weight average molecular weight Mw of the toner obtained by the GPC measurement is 58,300 and the peak area that the molecular weight of the toner is 1,000 or lower obtained by a GPC peak slice method is 0.2% of the whole. Also, the glass transition temperature of the toner is 64.5° C. When the particle sizes of the toner are measured by a Coulter counter, the volume mean particle size $D_{50}$ is 4.29 $\mu$m, the volume mean particle size distribution index GSDv is 1.22, the ratio of the volume mean particle size distribution index GSDv to the number mean particle size distribution GSDp is 1.17. Furthermore, it is observed that the shape factor SF1 of the toner particles obtained by the form observation by Luzex is 120 and a sphere form. When the cross-sectional image of the toner is observed by transmission type electron microscope (TEM), the releasing agent is dispersed in the toner particles, the center diameter (median diameter) of the releasing agent is 342 nm, and the center diameter (median diameter) of the colorsnt is 126 nm.

When the charging property of the toner is measured, the toner shows a good charging property of −28.6 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 4

About the above-described toner 4, when the crossover temperature of the storage elastic modulus G' and the loss elastic modulus G" is obtained from the temperature dispersion measurement of the dynamic viscoelasticity measurement, it is 64° C. Also, the weight average molecular weight Mw of the toner obtained by the GPC measurement is 58,090 and the peak area that the molecular weight of the toner is 1,000 or lower obtained by a GPC peak slice method is 0.6% of the whole. Also, the glass transition temperature of the toner is 50.5° C. When the particle sizes of the toner are measured by a Coulter counter, the volume mean particle size $D_{50}$ is 5.14 $\mu$m, the volume mean particle size distribution index GSDv is 1.24, the ratio of the volume mean particle size distribution index GSDv to the number mean particle size distribution GSDp is 1.20. Furthermore, it is observed that the shape factor SF1 of the toner particles obtained by the form observation by Luzex is 117 and a sphere form. When the cross-sectional image of the toner is observed by transmission type electron microscope (TEM), the releasing agent is dispersed in the toner particles, the center diameter (median diameter) of the releasing agent is 1328 nm, and the center diameter (median diameter) of the colorant is 221 nm.

When the charging property of the toner is measured, the toner shows a good charging property of −21.9 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 5

About the above-described toner 5, when the crossover temperature of the storage elastic modulus G' and the loss elastic modulus G" is obtained from the temperature dispersion measurement of the dynamic viscoelasticity measurement, it is 68° C. Also, the weight average molecular weight Mw of the toner obtained by the GPC measurement is 44,850 and the peak area that the molecular weight of the toner is 1,000 or lower obtained by a GPC peak slice method is 1.0% of the whole. Also, the glass transition temperature of the toner is 62° C. When the particle sizes of the toner are measured by a Coulter counter, the volume mean particle size $D_{50}$ is 5.24 μm, the volume mean particle size distribution index GSDv is 1.23, the ratio of the volume mean particle size distribution index GSDV to the number mean particle size distribution GSDp is 1.11. Furthermore, it is observed that the shape factor SF1 of the toner particles obtained by the form observation by Luzex is 137 and a potato form. When the cross-sectional image of the toner is observed by transmission type electron microscope (TEM), the releasing agent is dispersed in the toner particles, the center diameter (median diameter) of the releasing agent is 394 nm, and the center diameter (median diameter) of the colorant is 268 nm.

When the charging property of the toner is measured, the toner shows a good charging property of −29.7 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 6

About the above-described toner 6, when the crossover temperature of the storage elastic modulus G' and the loss elastic modulus G" is obtained from the temperature dispersion measurement of the dynamic viscoelasticity measurement, it is 70° C. Also, the weight average molecular weight Mw of the toner obtained by the GPC measurement is 48,600 and the peak area that the molecular weight of the toner is 1,000 or lower obtained by a GPC peak slice method is 1.9% of the whole. Also, the glass transition temperature of the toner is 58.5° C. When the particle sizes of the toner are measured by a Coulter counter, the volume mean particle size $D_{50}$ is 8.87 μm, the volume mean particle size distribution index GSDv is 1.19, the ratio of the volume mean particle size distribution index GSDv to the number mean particle size distribution GSDp is 1.20. Furthermore, it is observed that the shape factor SF1 of the toner particles obtained by the form observation by Luzex is 119 and a sphere form. When the cross-sectional image of the toner is observed by transmission type electron microscope (TEM), the releasing agent is dispersed in the toner particles, the center diameter (median diameter) of the releasing agent is 764 nm, and the center diameter (median diameter) of the colorant is 110 nm.

When the charging property of the toner is measured, the toner shows a good charging property of −21.4 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 7

About the above-described toner 7, when the crossover temperature of the storage elastic modulus G' and the loss elastic modulus G" is obtained from the temperature dispersion measurement of the dynamic viscoelasticity measurement, it is 65° C. Also, the weight average molecular weight Mw of the toner obtained by the GPC measurement is 43,280 and the peak area that the molecular weight of the toner is 1,000 or lower obtained by a GPC peak slice method is 2.5% of the whole. Also, the glass transition temperature of the toner is 51° C. When the particle sizes of the toner are measured by a Coulter counter, the volume mean particle size $D_{50}$ is 3.38 μm, the volume mean particle size distribution index GSDv is 1.20, the ratio of the volume mean particle size distribution index GSDv to the number mean particle size distribution GSDp is 1.15. Furthermore, it is observed that the shape factor SF1 of the toner particles obtained by the form observation by Luzex is 136 and a potato form. When the cross-sectional image of the toner is observed by transmission type electron microscope (TEM), the releasing agent is dispersed in the toner particles, the center diameter (median diameter) of the releasing agent is 298 nm, and the center diameter (median diameter) of the colorant is 178 nm.

When the charging property of the toner is measured, the toner shows a good charging property of −38.7 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which showed that the transparency is good. Also, the document offset property of the fixed output image is good and no offset occurs. Furthermore, the bending resistance of the fixed image is good.

EXAMPLE 8

About the above-described toner 8, when the crossover temperature of the storage elastic modulus G' and the loss elastic modulus G" is obtained from the temperature dispersion measurement of the dynamic viscoelasticity measurement, it is 60° C. Also, the weight average molecular weight Mw of the toner obtained by the GPC measurement is 22,100 and the peak area that the molecular weight of the toner is 1,000 or lower obtained by a GPC peak slice method is 3.0% of the whole. Also, the glass transition temperature of the toner is 50° C. When the particle sizes of the toner are measured by a Coulter counter, the volume mean particle size $D_{50}$ is 8.02 μm, the volume mean particle size distribution index GSDv is 1.30, the ratio of the volume mean particle size distribution index GSDv to the number mean particle size distribution GSDp is 1.19. Furthermore, it is observed that the shape factor SF1 of the toner particles obtained by the form observation by Luzex is 112 and a sphere form. When the cross-sectional image of the toner is observed by transmission type electron microscope (TEM), the releasing agent is dispersed in the toner particles, the center diameter (median diameter) of the releasing agent is 152 nm, and the center diameter (median diameter) of the colorant is 103 nm.

When the charging property of the toner is measured, the toner shows a good charging property of −20.3 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which showed that the transparency is good. Also, the document offset property of the fixed output image is good and no offset occurs. Furthermore, the bending resistance of the fixed image is good.

EXAMPLE 9

About the above-described toner 12, when the crossover temperature of the storage elastic modulus G' and the loss elastic modulus G" is obtained from the temperature dispersion measurement of the dynamic viscoelasticity measurement, it is 60° C. Also, the weight average molecular weight Mw of the toner obtained by the GPC measurement is 32,440 and the peak area that the molecular weight of the toner is 1,000 or lower obtained by a GPC peak slice method is 1.9% of the whole. Also, the glass transition temperature of the toner is 54° C. When the particle sizes of the toner are measured by a Coulter counter, the volume mean particle size $D_{50}$ is 6.47 μm, the volume mean particle size distribution index GSDv is 1.27, the ratio of the volume mean particle size distribution index GSDv to the number mean particle size distribution GSDp is 1.24. Furthermore, it is observed that the shape factor SF1 of the toner particles obtained by the form observation by Luzex is 120 and a sphere form. When the cross-sectional image of the toner is observed by transmission type electron microscope (TEM), the releasing agent is dispersed in the toner particles, the center diameter (median diameter) of the releasing agent is 184 nm, and the center diameter (median diameter) of the colorant is 150 nm.

When the charging property of the toner is measured, the toner shows a good charging property of −29.1 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 10

About the above-described toner 13, when the crossover temperature of the storage elastic modulus G' and the loss elastic modulus G" is obtained from the temperature dispersion measurement of the dynamic viscoelasticity measurement, it is 65° C. Also, the weight average molecular weight Mw of the toner obtained by the GPC measurement is 64,930 and the peak area that the molecular weight of the toner is 1,000 or lower obtained by a GPC peak slice method is 1.4% of the whole. Also, the glass transition temperature of the toner is 50.5° C. When the particle sizes of the toner are measured by a Coulter counter, the volume mean particle size $D_{50}$ is 6.98 μm, the volume mean particle size distribution index GSDv is 1.19, the ratio of the volume mean particle size distribution index GSDv to the number mean particle size distribution GSDp is 1.18. Furthermore, it is observed that the shape factor SF1 of the toner particles obtained by the form observation by Luzex is 131 and round potato form. When the cross-sectional image of the toner is observed by transmission type electron microscope (TEM), the releasing agent is dispersed in the toner particles, the center diameter (median diameter) of the releasing agent is 193 nm, and the center diameter (median diameter) of the colorant is 218 nm.

When the charging property of the toner is measured, the toner shows a good charging property of −29.2 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 11

About the above-described toner 14, when the crossover temperature of the storage elastic modulus G' and the loss elastic modulus G" is obtained from the temperature dispersion measurement of the dynamic viscoelasticity measurement, it is 73.5° C. Also, the weight average molecular weight Mw of the toner obtained by the GPC measurement is 33,680 and the peak area that the molecular weight of the toner is 1,000 or lower obtained by a GPC peak slice method is 1.9% of the whole. Also, the glass transition temperature of the toner is 65° C. When the particle sizes of the toner are measured by a Coulter counter, the volume mean particle size $D_{50}$ is 7.86 $\mu$m, the volume mean particle size distribution index GSDv is 1.24, the ratio of the volume mean particle size distribution index GSDv to the number mean particle size distribution GSDp is 1.20. Furthermore, it is observed that the shape factor SF1 of the toner particles obtained by the form observation by Luzex is 118 and a sphere form. When the cross-sectional image of the toner is observed by transmission type electron microscope (TEM), the releasing agent is dispersed in the toner particles, the center diameter (median diameter) of the releasing agent is 1497 nm, and the center diameter (median diameter) of the colorant is 304 nm.

When the charging property of the toner is measured, the toner shows a good charging property of −35.8 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 12

About the above-described toner 15, when the crossover temperature of the storage elastic modulus G' and the loss elastic modulus G" is obtained from the temperature dispersion measurement of the dynamic viscoelasticity measurement, it is 62° C. Also, the weight average molecular weight Mw of the toner obtained by the GPC measurement is 46,500 and the peak area that the molecular weight of the toner is 1,000 or lower obtained by a GPC peak slice method is 1.5% of the whole. Also, the glass transition temperature of the toner is 63° C. When the particle sizes of the toner are measured by a Coulter counter, the volume mean particle size $D_{50}$ is 8.96 $\mu$m, the volume mean particle size distribution index GSDv is 1.20, the ratio of the volume mean particle size distribution index GSDv to the number mean particle size distribution GSDp is 1.28. Furthermore, it is observed that the shape factor SF1 of the toner particles obtained by the form observation by Luzex is 125 and a round potato form. When the cross-sectional image of the toner is observed by transmission type electron microscope (TEM), the releasing agent is dispersed in the toner particles, the center diameter (median diameter) of the releasing agent is 1489 nm, and the center diameter (median diameter) of the colorant is 328 nm.

When the charging property of the toner is measured, the toner shows a good charging property of −21.9 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good and no offset occurs. Furthermore, the bending resistance of the fixed image is good.

EXAMPLE 13

About the above-described toner 16, when the crossover temperature of the storage elastic modulus G' and the loss elastic modulus G" is obtained from the temperature dispersion measurement of the dynamic viscoelasticity measurement, it is 62° C. Also, the weight average molecular weight Mw of the toner obtained by the GPC measurement is 24,850 and the peak area that the molecular weight of the toner is 1,000 or lower obtained by a GPC peak slice method is 3.0% of the whole. Also, the glass transition temperature of the toner is 50° C. When the particle sizes of the toner are measured by a Coulter counter, the volume mean particle size $D_{50}$ is 3.02 $\mu$m, the volume mean particle size distribution index GSDv is 1.18, the ratio of the volume mean particle size distribution index GSDv to the number mean particle size distribution GSDp is 1.30. Furthermore, it is observed that the shape factor SF1 of the toner particles obtained by the form observation by Luzex is 140 and a potato form. When the cross-sectional image of the toner is observed by transmission type electron microscope (TEM), the releasing agent is dispersed in the toner particles, the center diameter (median diameter) of the releasing agent is 1294 nm, and the center diameter (median diameter) of the colorant is 154 nm.

When the charging property of the toner is measured, the toner shows a good charging property of −27.6 $\mu$C/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., the oil less fixing property by a PFA tube roller is good and also the fixing sheet can be released without resistance. Also, the surface gloss of the fixing sheet is good.

Furthermore, when the transparency of the OHP sheet is determined, a transparent image having no turbidity is confirmed, which shows that the transparency is good. Also, the document offset property of the fixed output image is good. and no offset occurs. Furthermore, the bending resistance of the fixed image is good.

EXAMPLE 14

About the above-described toner 21, when the crossover temperature of the storage elastic modulus G' and the loss elastic modulus G" is obtained from the temperature dispersion measurement of the dynamic viscoelasticity measurement, it is 60.5° C. Also, the weight average molecular weight Mw of the toner obtained by the GPC measurement is 21,790 and the peak area that the molecular weight of the toner is 1,000 or lower obtained by a GPC peak slice method is 3.0% of the whole. Also, the glass transition temperature of the toner is 50° C. When the particle sizes of the toner are measured by a Coulter counter, the volume mean particle size $D_{50}$ is 5.10 μm, the volume mean particle size distribution index GSDv is 1.23, the ratio of the volume mean particle size distribution index GSDv to the number mean particle size distribution GSDp is 0.98. Furthermore, it is observed that the shape factor SF1 of the toner particles obtained by the form observation by Luzex is 146 and a random form. When the cross-sectional image of the toner is observed by transmission type electron microscope (TEM), the releasing agent is dispersed in the toner particles, the center diameter (median diameter) of the releasing agent is 234 nm, and the center diameter (median diameter) of the colorant is 193 nm.

When the charging property of the toner is measured, the toner shows a good charging property of −27.6 μC/g in the environment of 23° C. and 60% RH. When an image is formed using the toner, the image density is good and no defects of toner scattering, the formation of toner, etc., are observed.

When the fixing property of the toner is determined using a modified machine of A Color 635, manufactured by Fuji Xerox Co., Ltd., in the oil less fixing property test by a PFA tube roller, a slight claw mark is observed on the fixing sheet. Also, the surface gloss of the fixing sheet is good.

Furthermore, when the transparency of the OHP sheet is determined, a transparent image having no turbidity is confirmed, which shows that the transparency is good. Also, in the document offset property of the fixed output image, there are no image defects but an image transfer is observed. Furthermore, the bending resistance of the fixed image is good.

COMPARATIVE EXAMPLE 1

About the above-described toner 9, when the crossover temperature of the storage elastic modulus G' and the loss elastic modulus G" is obtained from the temperature dispersion measurement of the dynamic viscoelasticity measurement, it is 58° C. Also, the weight average molecular weight Mw of the toner obtained by the GPC measurement is 63,420 and the peak area that the molecular weight of the toner is 1,000 or lower obtained by a GPC peak slice method is 2.7% of the whole. Also, the glass transition temperature of the toner is 48.1° C. When the particle sizes of the toner are measured by a Coulter counter, the volume mean particle size $D_{50}$ is 9.5 μm, the volume mean particle size distribution index GSDv is 1.25, the ratio of the volume mean particle size distribution index GSDv to the number mean particle size distribution GSDp is 1.24. Furthermore, it is observed that the shape factor SF1 of the toner particles obtained by the form observation by Luzex is 108 and a sphere form. When the cross-sectional image of the toner is observed by transmission type electron microscope (TEM), the releasing agent is dispersed in the toner particles, the center diameter (median diameter) of the releasing agent is 1011 nm, and the center diameter (median diameter) of the colorant is 284 nm.

When the charging property of the toner is measured, the toner shows a good charging property of −18 μC/g in the environment of 23° C. and 60% RH. The image density is good but scattering of the toner and fogs occurs.

Also, when the fixing property of the toner is determined using a modified machine of A Color 635, manufactured by Fuji Xerox Co., Ltd., the oil less fixing property test by a PFA tube roller is good and also the fixing sheet can be released without resistance. Also, the surface gloss of the fixing sheet is low and ununiform.

In the OHP image, it is observed that image is blackish a little. The document offset property of the fixed output image is bad. Also, the bending resistance of the fixed image is good.

COMPARATIVE EXAMPLE 2

About the above-described toner 10, when the crossover temperature of the storage elastic modulus G' and the loss elastic modulus G" is obtained from the temperature dispersion measurement of the dynamic viscoelasticity measurement, it is 59° C. Also, the weight average molecular weight Mw of the toner obtained by the GPC measurement is 19,800 and the peak area that the molecular weight of the toner is 1,000 or lower obtained by a GPC peak slice method is 6.4% of the whole. Also, the glass transition temperature of the toner is 54° C. When the particle sizes of the toner are measured by a Coulter counter, the volume mean particle size $D_{50}$ is 9.5 μm, the volume mean particle size distribution index GSDv is 1.23, the ratio of the volume mean particle size distribution index GSDv to the number mean particle size distribution GSDp is 1.06. Furthermore, it is observed that the shape factor SF1 of the toner particles obtained by the form observation by Luzex is 121 and a potato form. When the cross-sectional image of the toner is observed by transmission type electron microscope (TEM), the releasing agent is dispersed in the toner particles, the center diameter (median diameter) of the releasing agent is 131 nm, and the center diameter (median diameter) of the colorant is 89 nm.

When the charging property of the toner is measured, the charging property is −42 μC/g in the environment of 23° C., 60% RH, and a sufficient image density is not obtained.

Also, when the fixing property of the toner is determined using a modified machine of A Color 635, manufactured by Fuji Xerox Co., Ltd., in the oil less fixing property test by a PFA tube roller, winding round the roller occurs. Also, the surface gloss of the fixing sheet is low and ununiform.

The OHP image has a transparency and is good. The document offset property of the fixed output image is bad. Also, in the bending resistance of the fixed image, an image loss is observed a little.

COMPARATIVE EXAMPLE 3

About the above-described toner 11, when the crossover temperature of the storage elastic modulus G' and the loss elastic modulus G" is obtained from the temperature dispersion measurement of the dynamic viscoelasticity measurement, it is 76° C. Also, the weight average molecular weight Mw of the toner obtained by the GPC measurement is 25,400 and the peak area that the molecular weight of the toner is 1,000 or lower obtained by a GPC peak slice method shows a large value as 10.1% of the whole. Also, the glass transition temperature of the toner is 67° C. When the particle sizes of the toner are measured by a Coulter counter, the volume mean particle size $D_{50}$ is 5.24 μm, the volume mean particle size distribution index GSDv is 1.24, the ratio of the volume mean particle size distribution index GSDv to the number mean particle size distribution GSDp is 1.14. Furthermore, it is observed that the shape factor SF1 of the toner particles obtained by the form observation by Luzex is 133 and a roundish potato form. When the cross-sectional image of the toner is observed by transmission type electron microscope (TEM), the releasing agent is dispersed in the toner particles, the center diameter (median diameter) of the releasing agent is 1637 nm, and the center diameter (median diameter) of the colorant is 421 nm.

When the charging property of the toner is measured, the toner shows a good charging property of −21 μC/g in the environment of 23° C. and 60% RH. When an image is formed using the toner, the image density is good and no defects of toner scattering, the formation of toner, etc., are observed.

Also, when the fixing property of the toner is determined using a modified machine of A Color 635, manufactured by Fuji Xerox Co., Ltd., the oil less fixing property by a PFA tube roller is good and also the fixing sheet can be released without resistance. However, the surface gloss of the fixing sheet is ununiform.

The OHP image is indistinct and blackish. A document offset of the fixed output image occurs a little. The bending resistance of the fixed image is bade and image defects occurs.

TABLE 1

| | Example 1 | Example 2 | Example 3 | Example 4 | Example 5 | Example 6 | Example 7 |
|---|---|---|---|---|---|---|---|
| Crossover temperature of G' and G" | 62.5° C. | 72° C. | 75° C. | 64° C. | 68° C. | 70° C. | 65° C. |
| Molecular weight by GPC measurement | 30020 | 63400 | 58300 | 58090 | 44850 | 48600 | 43280 |
| Molecular weight ratio of less than 1000 | 2.5% | 0.3% | 0.2% | 0.6% | 1.0% | 1.9% | 2.5% |
| Glass transition point of toner | 54° C. | 50.5° C. | 64.5° C. | 50.5° C. | 62° C. | 58.5° C. | 51° C. |
| Volume mean particle size $D_{50}$ of toner | 5.43μ | 3.14μ | 4.29μ | 5.14μ | 5.24μ | 8.87μ | 3.38μ |
| Particle size distribution index GSDv | 1.23 | 1.21 | 1.22 | 1.24 | 1.23 | 1.19 | 1.20 |
| GSDv/GSDp | 1.10 | 1.08 | 1.17 | 1.20 | 1.11 | 1.20 | 1.15 |
| Shape factor SF1 | 117 | 123 | 120 | 117 | 137 | 119 | 136 |
| Content of releasing agent (wt. %) | 9.04 | 6.80 | 19.8 | 18.5 | 6.64 | 16.0 | 8.08 |
| Content of coloring agent (wt. %) | 6.97 | 7.68 | 9.04 | 4.00 | 10.7 | 4.96 | 4.88 |
| Median diameter of coloring agent particles | 168 nm | 316 nm | 126 nm | 221 nm | 268 nm | 110 nm | 178 nm |
| Median diameter of releasing agent particles | 837 nm | 512 nm | 342 nm | 1328 nm | 394 nm | 764 nm | 298 nm |
| Charged amount of toner (μC/g) | −38.4 | −26.4 | −28.6 | −1 .9 | −29.7 | −21 .4 | −38.7 |
| Image density | good | good | good | good | good | good | good |
| Scattering of toner and fog | none | none | none | none | none | none | none |
| Releasing property of fixing sheet | good | good | good | good | good | good | good |
| Surface gloss of fixing sheet | good | good | good | good | good | good | good |
| OHP transparency | good | good | good | good | good | good | good |
| Document offset | good | good | good | good | good | good | good |
| Bending resistance of image | good | good | good | good | good | good | good |

TABLE 2

| | Example 8 | Example 9 | Example 10 | Example 11 | Example 12 | Example 13 | Example 14 |
|---|---|---|---|---|---|---|---|
| Crossover temperature of G' and G" | 60° C. | 60° C. | 65° C. | 73.5° C. | 62° C. | 62° C. | 60.5° C. |
| Molecular weight by GPC measurement | 22100 | 32440 | 64930 | 33680 | 46500 | 24850 | 21790 |
| Molecular weight ratio of less than 1000 | 3.0% | 1.9% | 1.4% | 1.9% | 1.5% | 3.0% | 3.0% |
| Glass transition point of toner | 50° C. | 54° C. | 50.5° C. | 65° C. | 63° C. | 50° C. | 50° C. |
| Volume mean particle size $D_{50}$ of toner | 8.02μ | 6.47μ | 6.98μ | 7.86μ | 8.96μ | 3.02μ | 5.1μ |
| Particle size distribution index GSDv | 1.30 | 1.27 | 1.19 | 1.24 | 1.20 | 1.18 | 1.23 |
| GSDv/GSDp | 1.19 | 1.24 | 1.18 | 1.20 | 1.28 | 1.30 | 0.98 |
| Shape factor SF1 | 112 | 120 | 131 | 118 | 125 | 140 | 146 |
| Content of releasing agent (wt. %) | 6.64 | 9.04 | 6.80 | 19.8 | 6.64 | 6.64 | 12.4 |
| Content of coloring agent (wt. %) | 4.96 | 6.97 | 7.68 | 9.04 | 10.7 | 4.96 | 8.00 |
| Median diameter of coloring agent particles | 103 nm | 150 nm | 218 nm | 304 nm | 328 nm | 154 nm | 193 nm |
| Median diameter of releasing agent particles | 152 nm | 184 nm | 193 nm | 1497 nm | 1489 nm | 1294 nm | 234 nm |
| Charged amount of toner (μC/g) | 20.3 | 29.1 | 29.2 | 35.8 | 21.9 | 27.6 | 27.6 |
| Image density | good | good | good | good | good | good | good |
| Scattering of toner and fog | none | none | none | none | none | none | none |
| Releasing property of fixing sheet | good | good | good | good | good | good | slight claw mark |
| Surface gloss of fixing sheet | good | good | good | good | good | good | good |
| OHP transparency | good | good | good | good | good | good | good |
| Document offset | good | good | good | good | good | good | image transfer |
| Bending resistance of image | good | good | good | good | good | good | good |

TABLE 3

| | Comparative Example 1 | Comparative Example 2 | Comparative Example 3 |
|---|---|---|---|
| Crossover temperature of G' and G" | 58° C. | 59° C. | 76° C. |
| Molecular weight by GPC measurement | 63420 | 19800 | 25400 |
| Molecular weight ratio of less than 1000 | 2.7% | 6.4% | 10.1% |
| Glass transition point of toner | 48.1° C. | 54° C. | 67° C. |
| Volume mean particle size $D_{50}$ of toner | 9.5μ | 9.5μ | 5.24μ |
| Particle size distribution index GSDv | 1.25 | 1.23 | 1.24 |
| GSDv/GSDp | 1.24 | 1.06 | 1.14 |
| Shape factor SF1 | 108 | 121 | 133 |
| Content of releasing agent (wt. %) | 23.2 | 3.44 | 9.68 |
| Content of coloring agent (wt. %) | 280 | 12.8 | 7.76 |
| Median diameter of coloring agent particles | 284 nm | 89 nm | 421 nm |
| Median diameter of releasing agent particles | 1011 nm | 131 nm | 1637 nm |
| Charged amount of toner (μC/g) | −18 | −42 | −21 |
| Image density | good | low | good |
| Scattering of toner and fog | occurred | none | none |
| Releasing property of fixing sheet | good | roller-wound | good |
| Surface gloss of fixing sheet | low | low | low |
| OHP transparency | blackish a little | good | indistinct black |
| Document offset | bad | bad | occurred a little |
| Bending resistance of image | good | slight loss | image loss |

As described above, by employing the above-described construction of this invention, toner images excellent in the fixing characteristics such as the document offset property, the bending resistance of the fixed image, the oil less fixing property by a PFA tube roller, the releasing property of the fixing sheet, the transparency of the OHP images, etc.; having the charging uniformity and the high stability, and giving no toner fog and toner scattering, etc., can be provided.

What is claimed is:

1. An electrostatic image developing toner wherein the lowest temperature of the dynamic viscoelsaticity of the toner, at which the value of the storage elastic modulus (G') of the toner coincides with the value of the loss elastic modulus (G") of the toner obtained under a frequency of 6.28 rad/second in a temperature dispersion measurement at a temperature of at least 0° C., is in a range of from 60 to 75° C., and the weight average molecular weight of the toner, obtained by measurement of a gel permeation chromatogaphy, is in a range of from 20,000 to 65,000 and the peak area is not larger than 1,000 of the molecular weight obtained by the gel permeation chromatography measurement is 3% or lower of the whole area thereof.

2. The electrostatic image developing toner according to claim 1, wherein the glass transition temperature (Tg) of the toner is in the range of from 50 to 65° C.

3. The electrostatic image developing toner according to claim 1, wherein the volume mean particle size distribution index GSDv of the toner is not more than 1.30 and the ratio of said GSDv to the number mean particle size distribution index GSDp of the toner is at least 0.95.

4. The electrostatic image developing toner according to claim 1, further comprising a releasing agent which content is in the range of from 5 to 25% by weight converted as solid components.

5. The electrostatic image developing toner according to claim 4, wherein the median diameter (center diameter) of the releasing agent particles dispersed in the toner is in the range of from 150 to 1500 nm measured by a transmission type electron microscope (TEM).

6. The electrostatic image developing toner according to claim 1, further comprising a colorant which content is in the range of from 4 to 15% by weight converted as solid components.

7. The electrostatic image developing toner according to claim 6, wherein the median diameter (center diameter) of the coloring agent particles dispersed in the toner is in the range of from 100 to 330 nm measured by a transmission type electron microscope (TEM).

8. The electrostatic image developing toner according to claim 1, wherein shape factor SF1 of the toner is in the range of from 110 to 145.

9. The electrostatic image developing toner according to claim 1, wherein volume mean particle size $D_{50}$ of the toner is in the range of from 3 to 9 μm.

10. The electrostatic image developing toner according claim 1, wherein charged amount of the toner is in the range of from 20 to 40 μC/g in the absolute value.

11. A method of preparing the electrostatic image developing toner described in claim 1, comprising a step of preparing a dispersion liquid of aggregated particles containing resin fine particles, a coloring agent, and a releasing agent by mixing a resin fine particle dispersion liquid, having dispersed resin fine particles which particle sizes is not larger than 1 μm, a coloring agent dispersion liquid, and a releasing agent dispersion in a presence of at least one kind of a polymer of a metal salt and a step of heating the aggregated particles to a temperature of at least a glass transition point of the above-described resin fine particles to coalesce the above-described aggregated particles.

12. The method of preparing the electrostatic image developing toner according to claim 11, wherein in succession the preparation step of the aggregated particle dispersion, further comprising a step of forming attached particles by mixing the above-described aggregated particle dispersion and the resin fine particle dispersion to attach the resin fine particles to the surfaces of the aggregated particles and a step of coalescing the attached particles.

13. The method of producing the electrostatic image developing toner according to claim 11, wherein mean particle size of the above-described resin fine particles attaching to the aggregated particles is not larger than 1 μm.

14. The method of producing the electrostatic image developing toner according to claim 11, wherein the polymer of a metal saltis a polymer of the inorganic metal salt of tetravalent aluminum.

15. An electrostatic image developer, comprising a carrier and a toner described in claim 1.

16. The electrostatic image developer according to claim 15, said carrier has a resin coating layer.

17. An image-forming method comprising a step of forming an electrostatic latent image on an electrostatic image-carrier, forming a toner image by developing the electrostatic latent image with a developer on a developer-carrier, transferring the toner image onto a transfer material, transferring the toner image on the transfer material onto fixing sheet, and heat-fixing the transferred toner image, wherein as the developer, the electrostatic image developer described in claim 16 is used.

18. The image-forming method according to claim 17, further comprising a step of recovering the remaining toner on the electrostatic image-carrier after transferring and a step of recycling said recovered toner onto the developer-carrier.

* * * * *